US006237567B1

(12) United States Patent
Nakano et al.

(10) Patent No.: US 6,237,567 B1
(45) Date of Patent: May 29, 2001

(54) FUEL-INJECTION SYSTEM FOR ENGINE

(75) Inventors: Futoshi Nakano; Suzuhiro Saiki; Tadashi Uchiyama, all of Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/249,771

(22) Filed: Feb. 16, 1999

(30) Foreign Application Priority Data

Feb. 18, 1998 (JP) ..... 10-051295
Feb. 18, 1998 (JP) ..... 10-051296

(51) Int. Cl.[7] ..... F02M 33/04
(52) U.S. Cl. ..... 123/446; 123/486; 123/478
(58) Field of Search ..... 123/446, 447, 123/486, 490, 478

(56) References Cited

U.S. PATENT DOCUMENTS

| | | | | |
|---|---|---|---|---|
| 5,357,912 | * | 10/1994 | Barnes et al. | 123/357 |
| 5,423,302 | * | 6/1995 | Glassey | 123/446 |
| 5,445,129 | * | 8/1995 | Barnes | 123/446 |
| 5,477,828 | * | 12/1995 | Barnes | 123/478 |
| 5,586,538 | * | 12/1996 | Barnes | 123/446 |
| 5,711,273 | * | 1/1998 | Barnes et al. | 123/446 |
| 5,957,111 | * | 9/1999 | Rodier | 123/458 |
| 6,014,956 | * | 1/2000 | Cowden et al. | 123/446 |

FOREIGN PATENT DOCUMENTS

| | | |
|---|---|---|
| 639073 | 10/1994 | (JP) . |
| 6511527 | 12/1994 | (JP) . |
| 849591 | 2/1996 | (JP) . |

* cited by examiner

*Primary Examiner*—Thomas N. Moulis
(74) *Attorney, Agent, or Firm*—Browdy & Neimark

(57) ABSTRACT

A fuel-injection system for an engine is disclosed in which a standard conductive duration of the individual injectors required for a desired volume of fuel injected per cycle may be easily provided by correcting a standard conductive duration to a solenoid-operated valve, which has been found depending on a standard fuel-injection characteristic. A controller unit is stored with a standard fuel-injection characteristic A that is used for obtaining a standard actuating pulse width Pws for the standard conductive duration corresponding to a desired volume Qf of the injected fuel, which is required depending on the operating conditions of the engine. A specified operating point (Q1, Pw1) is a known data that has been previously observed for the individual injectors. The actuating pulse width Pw necessary for determining the desired volume Qf of injected fuel is given by multiplying the standard actuating pulse width Pw1 by a correction coefficient that is a ratio of the standard actuating pulse width Pws1 to the specified actuating pulse width Pw1. The correction coefficient is computed at plural selected pressure ranges of a hydraulically actuated fluid while the process of interpolation provides the correction coefficient at the residual pressure ranges. This makes it possible to eliminate the stoop change of the correction coefficient K with the result of the protection of the engine from torque-shock.

7 Claims, 9 Drawing Sheets

FUEL-INJECTION SYSTEM FOR ENGINE

BACKGROUND OF THE INVENTION

1. Field of the Invention

The present invention relates to a fuel-injection system having injectors that may inject fuel in accordance with fuel-injection characteristics, which is dependent on operating conditions of an engine.

2. Description of the Prior Art

A fuel-injection system has been well known in which an injector is provided with a needle valve movable in an injector body in a reciprocating manner to open and close injection holes, and a solenoid-operated valve having an electromagnetic actuator that is applied with an actuating current so as to control a hydraulically actuated fluid for driving the needle valve upwards and downwards, whereby the fuel to be injected out of the injector is regulated in injection timing and volume of injected fuel per cycle by a controller unit in response to the operating conditions of the engine.

There have been conventionally known two types of the injector used in the fuel-injection system, one of which is comprised of a solenoid-operated valve to control an ingress of the hydraulically actuated fluid, or hydraulic oil, into the injector body, and a boosting piston to pressurize the fuel in an intensified chamber, whereby the pressurized fuel makes the needle valve move so as to inject the pressurized fuel through the injection holes that have been free from the needle valve. Another type of the injector operates so as to regulate an ingress and egress of the highly pressurized fuel, which is accumulated in a common fuel supply rail, to a controlled pressure chamber in the injector body, whereby the pressurized fuel makes the needle valve move so as to inject the pressurized fuel through the injection holes that have been free from the needle valve.

FIG. 7 shows a prior fuel-injection system in which is incorporated the former type of the injector. The multicylinder engines, for example, four-cylinder or six-cylinder engine, have been dominated in most modern engines to attain the high horsepower. The injectors are each assigned to each cylinder to inject the fuel into the combustion chamber. In the fuel-injection system in FIG. 7, the fuel may be fed from a fuel tank 52 to a common fuel supply rail 51 through a fuel filter 54 by the driving of a fuel pump 53. The common fuel supply rail 51 is communicated with each of the injectors 1. It will be thus understood that the injectors 1 are constantly supplied with the fuel of the required pressure at their fuel inlets 11 and fuel outlets 12 through the common fuel supply rail 51. The unconsumed fuel remaining in each injector 1 may return to the fuel tank 52 through a recovery line 55.

The injectors 1 are supplied with the hydraulically actuating fluid, or high-pressurized oil, from a high-pressure fluid manifold 56 through a solenoid-operated valve 10. The high-pressure fluid manifold 56 is fed with the fluid in a fluid reservoir 57 through a fluid supply line 61 by the driving of a fluid pump 58. There are provided a fluid cooler 59 and a fluid filter 60 midway in the fluid supply line 61. Moreover the fluid supply line 61 is branched into a lubricant line 67 communicating with an oil gallery 62 and a hydraulic fluid line 66 communicated with pressure chambers 8, shown in FIG. 8, in the injectors 1. A hydraulic pump 63 is provided in the hydraulic fluid line 66 while a flow control valve 64 regulates the fluid supply to the high-pressure fluid manifold 56 from the hydraulic pump 63. A controller unit 50 is to control both of the flow control valve 64 and solenoids 10 of the injectors 1. The controller unit 50 is applied with data indicative of the operating conditions of an engine, that is, rotational frequencies detected by a rotational frequency sensor 68, throttle valve openings detected by a accelerometer 69 and crankshaft angles detected by a crank angle sensor 70. The controller unit 50 is also input with a hydraulic pressure in the high-pressure manifold 56, which is detected by a pressure sensor 71 in the high-pressure fluid manifold 56. The crank angles detected by the crank angle sensor 70 are available to control the beginning and duration of the electric conduction of the actuating current per cycle, in cooperation with signals from sensors indicative that a piston has reached the top dead center or the pre-determined position just before the top dead center of the compression phase at any standard cylinder or each cylinder.

FIG. 8 is an axial cross-sectioned view showing an exemplary injector 1 incorporated in the fuel-injection system in FIG. 7. The injector 1 is comprised of a nozzle body 2 formed at a distal end thereof with fuel-injection holes 13, a solenoid body 3 having mounted thereon a solenoid 15 serving as the electromagnetic actuator, an injector body 4 and a fuel supply body 5. The injector 1 further includes an intensified chamber supplied with fuel from the common fuel supply rail 51, a pressure chamber 8 supplied with a hydraulically actuating fluid, a boosting piston 9 actuated by the hydraulically actuated fluid from the pressure chamber 8 to apply the pressure to the fuel in the intensified chamber 7, a return spring 17 for forcing the boosting piston 9 to return to its neutral position, and a casing 6 having a fuel inlet 11 and a fuel outlet 12, which are communicated with the common fuel supply rail 51 to thereby provide a fuel chamber in the casing 6. In the injector 1 described just above, a needle valve 23 may move upwards and downwards by the action of the fuel pressure from the intensified chamber 7 to thereby open and close the injection holes 13. A solenoid-operated valve 10 has a valve body 16 that is actuated by the solenoid 15 to regulate the hydraulically actuated fluid supplied to the pressure chamber 8. The boosting piston 9 is composed of a radially-enlarged portion 25 and a radially-reduced portion 24, the former portion 25 being arranged for reciprocating movement in a first concave 26 in the injector body 4 and provided with a bottom face to define partially the pressure chamber 8, and the latter portion 24 being arranged for reciprocating movement in a second concave 27 and provided with a bottom face to define partially the intensified chamber 7.

FIG. 9 illustrates fuel-injection characteristics in the injectors, which are expressed as the coordinate relation of an actuating pulse width Pw versus an volume Q of fuel injected per cycle with taking a parameter of a hydraulic pressure in the high-pressure fluid manifold 56, or a rail pressure Pr. These characteristics may be obtained by the measurement of the volume Q of injected fuel per cycle with respect to the actuating pulse width Pw that is at least longer or equal to a pre-determined width. According to the characteristics, it will be seen that, as the actuating pulse width Pw increases, the duration when the injection holes are open becomes longer and then the volume Q of injected fuel per cycle increases. It will be further understood that the higher the rail pressure Pr is, the higher is the speed of opening the injection holes and the greater is the fuel-injection ratio so that the volume of injected fuel increases.

Disclosed in Japanese Patent Laid-Open No. 49591/1996 is an exemplary fuel-injection system, likewise with the system described above with reference to FIG. 7, and an injector adapted to be used in the system. The injector in the above citation is composed of a control valve, an intensifier and a nozzle. Moreover, Published Japanese translations on PCT international publication No. 511527/1994 discloses a similar fuel-injection system and an injector therefor. In these prior fuel-injection systems, controlling the electric conduction timing and duration to the electromagnetic actuator makes the fuel-injection start at the desired beginning of the fuel-injection and continue for the desired duration with the desired fuel-injection pressure, whereby the desired volume of fuel per cycle may be injected into the engine.

The prior injectors for the engines, as described above, are hard to be steady, but usually varied or scattered in the fuel-injection characteristic owing to the mechanical errors inevitably originating in working, assembly or the like of the components. For example, even if the solenoid-operated valve in the injector is kept at constant in the standard conductive duration thereto, the injectors each are uneven in their volumes of fuel injected per cycle. The Japanese Utility Model Publication No. 39037/1994 discloses, for example, a fuel supply system that has for its object to achieve the moderate fuel-injection control by compensating the uneven flow-rate characteristics in the fuel-injection valves, thereby preventing the deterioration in output and exhaust performances of the engine. In the prior fuel supply system in this citation, the fuel-injection valves are previously divided into plural subgroups in accordance with the levels in the flow-rate characteristic. The engine is provided with a fuel-injection valve matching with any one selected subgroup and further provided with resistors each having a resistance value corresponding to each subgroup of the flow-rate characteristic. There is provided compensating means that may discriminate the flow-rate characteristic, depending on the resistance values of the resistors, to thereby compensate the pulse width of the injection pulse signal in response to the correction value corresponding to the associated flow-rate characteristic. The compensating means are further designed such that the fuel-injection valve may match with the subgroup of the medium flow-rate characteristic when the resistance value is in infinity.

To cope with the dispersion or scattering in fuel-injection characteristic of the injectors, although the improvement in working accuracy of the components in the injectors is any one of means for reducing the dispersion or scattering in the fuel-injection characteristic, it is very hard to completely eliminate such dispersion while improving the accuracy in working and assembly results in a steep rise in the production cost of the injector. It will be conceived to previously observe the data of the relation between the duration conductive to the solenoid-operated valve and the volume of the injected fuel at numerous plots for each of the individual injectors and store the resultant data into the controller unit. Nevertheless, this involves a major problem such that enormous efforts are required to take the data and the controller unit must carry out the vast steps of calculation, resulting in raising the production cost for not only the injector but also the fuel-injection system having incorporated the injector therein.

Instead of previous observation of the fuel-injection characteristics at all plotting areas for the individual injectors, it will be conceivable that the required fuel-injection control may be realized inexpensively by correcting the fuel-injection characteristic in only the standard injector to regulate the fuel-injection of the individual injectors. That is, even if there is the dispersion or scattering for each injector in the fuel-injection characteristic regarding the relation between the standard conductive duration of the actuating current to the electromagnetic actuator and the volume of fuel injected out of the injection holes, the standard fuel-injection (reference fuel-injection) characteristic is assigned beforehand to the standard (reference) injector having, for example, the central value of dispersion or scattering in fuel-injection characteristic. The controller unit may be stored with only the standard fuel-injection characteristic in place of the individual fuel-injection characteristics in each injector. With attention to a definite correlation between the standard fuel-injection characteristic in the standard injector regarding the relation of the standard (reference) conductive duration of the actuating current versus the volume of injected fuel, and the fuel-injection characteristics in the individual injectors regarding the relation of the standard conductive duration of the actuating current versus the volume of injected fuel, for example, a proportional correlation of the standard conductive duration versus the volume of injected fuel, the definite correlation may be found out from the information relating to a specific point in the fuel-injection characteristic of the individual injectors. Hence, the standard conductive duration of the actuating current in the individual injectors may be determined by the correction of the standard fuel-injection characteristic, depending on the definite correlation.

In general, when the operating load in the engine detected as the depression of an accelerator pedal undergoes a change, the pressure in the hydraulically actuated fluid forced out from the pump varies while the standard conductive duration of the actuating current to the solenoid-operated valve is made longer or shorter so that the volume of the injected fuel may increase or decrease. It is true that the correction of the standard conductive duration defined in a pressure range of the hydraulically actuated fluid is usually different from that in another pressure range of the fluid. With the hydraulically actuated fluid undergoing a pressure change at a pressure range between pressure ranges different from each other, the standard conductive duration varies stepwise and therefore the actual volume of injected fuel undergoes a steep change while the torque from the engine also varies suddenly to thereby cause what is known as torque-shock. It is thus preferred that the standard conductive duration of the actuating current is kept from its steep change even under the pressure variation in the hydraulically actuated fluid whereby the engine may be protected from the sudden changes in its output power.

SUMMARY OF THE INVENTION

A primary object of the present invention is to overcome the shortcomings in the prior art as having been described above, and to provide inexpensively a fuel-injection system for an engine, which has incorporated therein the injectors that are uneven in their fuel-injection characteristics. The fuel-injection system of the present invention may be provided without a steep rise in the production cost of the injector owing to the improvement in finishing accuracy of the components to eliminate the dispersion or scattering in the fuel-injection characteristic and also without enormous efforts to previously observe the data of the relation between the duration conductive to the solenoid-operated valve and the volume of the injected fuel at numerous plots for individual injectors.

An object of the present invention is to provide injectors and a fuel-injection system having incorporated therein, which may be inexpensively constructed without enormous efforts to previously observe the data of the relation between the standard conductive duration to the solenoid-operated valve and the volume of the injected fuel at numerous plots at every variation of the pressure in the hydraulically actuated fluid, and also to provide a fuel-injection system for an engine, which may be protected from the torque-shock owing to the sudden change in the actual volume of injected fuel at the pressure changes in the hydraulically actuated fluid.

This invention relates to a fuel-injection system for an engine, comprising injectors provided with injection holes through which fuel is injected into the engine and an electromagnetic actuator applied with an actuating current so as to control a hydraulically actuated fluid to open and close the injection holes, means for detecting operating conditions of the engine, and a controller unit for determining a desired volume of injected fuel correspondingly to the operating conditions obtained at the detecting means and further regulating a standard conductive duration of the actuating current to the electromagnetic actuator, depending on the desired volume of injected fuel, to thereby control a volume of fuel injected out of the injectors, the controller unit being stored with a standard fuel-injection characteristic that has been previously found in a relation between the volume of injected fuel versus a standard conductive duration whereby the standard conductive duration to the electromagnetic actuator of the injector for determining the desired volume of injected fuel is provided by correcting the standard conductive duration, which is found depending on the standard fuel-injection characteristic, by using a correction quantity (a correction constant).

Further, this invention relates to a fuel-injection system for an engine, comprising injectors each provided with injection holes through which fuel is injected into the engine and an electromagnetic actuator applied with an actuating current so as to control a hydraulically actuated fluid to open and close the injection holes, means for detecting operating conditions of the engine, and a controller unit for determining a desired volume of injected fuel correspondingly to the operating conditions obtained at the detecting means and further regulating the regulating the standard conductive duration of the actuating current to the electromagnetic actuator as well as the pressure of the hydraulically actuated fluid, depending on the desired volume of injected fuel, to thereby control a volume of fuel injected out of the injectors, the controller unit being stored with a standard fuel-injection characteristic that has been previously found in a relation between the volume of injected fuel and a standard conductive duration whereby the standard conductive duration to the electromagnetic actuator for determining the desired volume of injected fuel is provided by correcting the standard conductive duration, which is found correspondingly to the standard fuel-injection characteristic depending on the standard fuel-injection characteristic, by using a correction quantity, the correction quantity being obtained for each of plural selected pressure ranges while the correction quantity at residual pressure ranges between the selected pressure ranges being found by the interpolation of the correction quantity at the plural selected pressure ranges.

In an aspect of the present invention, the correction quantity is a correction coefficient to be multiplied by the standard conductive duration. On the other hand, in case where the correction quantity is the correction coefficient, the controller unit is stored with at least a pair of previously observed inherent data consisting of a specified conductive duration in the injectors and a specified volume of injected fuel corresponding to the specified conductive duration, and the correction coefficient is computed in the form of a ratio of the specified conductive duration in the injectors to the standard conductive duration that is given correspondingly to the specified volume of injected fuel, depending on the standard fuel-injection characteristic.

To find the correction quantity corresponding to each of the pressure ranges of the hydraulically actuated fluid, the controller unit is stored with previously observed inherent data consisting of pairs of a specified conductive duration to the electromagnetic actuator at each of the plural selected pressure ranges of the hydraulically actuated fluid and a specified volume of injected fuel corresponding to each the specified conductive duration, and the correction coefficient is computed correspondingly to each of the paired inherent data in the form of a ratio of the specified conductive duration to the electromagnetic actuator to the standard conductive duration.

In another aspect of the present invention, the correction quantity may be a corrected standard conductive duration to be added with the standard conductive duration.

The injectors are each provided with a solenoid-operated valve having a needle valve movable in a body upwards and downwards in a reciprocating manner so as to open and close the injection holes and the electromagnetic actuator applied with the actuating current to control a hydraulically actuated fluid to make the needle valve move upwards and downwards. Moreover the injectors are each comprised of an intensified chamber supplied with fuel from a common fuel supply rail, a pressure chamber supplied with the hydraulically actuated fluid, a boosting piston driven by the hydraulically actuated fluid to pressurize the fuel in the intensified chamber, a return spring for forcing the boosting piston towards its neutral position, and a casing formed with a fuel chamber and also a fuel inlet and a fuel outlet, both of which are communicated with the common fuel supply rail, the needle valve being made to move upwards and downwards dependently on the hydraulic pressure of the fuel from the intensified chamber to thereby open and close the injection holes through which is injected the fuel, and the solenoid-operated valve being provided with a valve body actuated by the electromagnetic actuator to regulate the supply of the hydraulically actuated fluid to the pressure chamber.

In case where the correction quantity is found for each of the plural selected pressure ranges of the hydraulically actuated fluid, the correction quantity at the residual pressure range between the plural selected pressure ranges is given by the linear interpolation of the correction quantitys. Further the plural selected pressure ranges and the correction quantity for the pressure ranges are of a paired low-pressure range and low-pressure correction quantity for the low-pressure range and another paired high-pressure range and high-pressure correction quantity for the high-pressure range.

The controller unit is stored with the standard fuel-injection characteristic that has been previously found as the relation between the standard conductive duration versus the volume of injected fuel and also calculates the desired volume of injected fuel depending on the output signals from the means that is to detect the operating conditions of the engine. No volume of injected fuel out of the injection holes usually reaches the desired volume of injected fuel by simply direct supply of the actuating current having the standard conductive duration that has been defined correspondingly to the standard fuel-injection characteristic. In contrast, the controller unit corrects the standard conductive duration that is obtained depending on the standard fuel-injection characteristic correspondingly to the desired volume of injected fuel. This makes it possible to attain the desired volume of fuel injected out of the injection holes of each of the individual injectors.

In case where the correction quantity for compensating the standard conductive duration is found correspondingly to each of plural selected pressure ranges of the hydraulically actuated fluid, the correction quantity of the residual pressure ranges is given by the process of interpolating the correction quantity at the selected pressure ranges of the hydraulically actuated fluid. The introduction of interpolation results in the smooth transition of the correction quantity without sudden variation from the selected pressure ranges from the residual pressure ranges, so that the volume of fuel injected actually may be undergo no steep change.

The controller unit is stored with at least a pair of previously observed inherent data at a specified operating point of each of the individual injectors, and the correction coefficient is computed by using the inherent data and the standard fuel-injection characteristic. The correction coefficient has experimentally been confirmed effectively adaptable for other operating points. Hence the standard conductive duration to the injectors enough to attain the desired volume of injected fuel may be given by multiplying the correction coefficient by the standard conductive duration that is obtained correspondingly to the desired volume of injected fuel, depending on the standard fuel-injection characteristic.

Moreover, where the correction coefficient is found at plural selected pressure ranges of the hydraulically actuated fluid, the controller unit is stored with plural pairs of the inherent data at each of specified operating points of the individual injectors, and the correction coefficients are computed by using the inherent data and the standard fuel-injection characteristic. Therefore, the standard conductive duration to the injectors enough for attaining the desired volume of injected fuel correspondingly to the operating conditions of the engine may be given by multiplying the correction coefficient by the standard conductive duration that is obtained correspondingly to the desired volume of injected fuel, depending on the standard fuel-injection characteristic. In this case, the correction quantitys are of a low-pressure correction quantity at the low-pressure range and another high-pressure correction quantity at the high-pressure range, while the correction quantity at the residual pressure range between the selected pressure ranges is given by the linear interpolation of the correction quantitys. This procedure may provide the simple calculation to find the correction quantity that is effective to keep the engine from the torque-shock.

The fuel-injection system described just above may be adapted to the type of injectors that are each provided with a solenoid-operated valve having a needle valve movable in a body upwards and downwards in a reciprocating manner so as to open and close the injection holes and the electromagnetic actuator applied with the actuating current to control a hydraulically actuated fluid to make the needle valve move upwards and downwards. In particular, the system of this invention is preferred to adapt for the injectors that are each comprised of an intensified chamber supplied with fuel from a common fuel supply rail, a pressure chamber supplied with the hydraulically actuated fluid, and a boosting piston driven by the hydraulically actuated fluid to pressurize the fuel in the intensified chamber.

The controller unit provides the standard conductive duration of the actuating current, which is to be applied to the electromagnetic actuators in the individual injectors, by correcting the standard conductive duration corresponding to the desired volume of injected fuel that is given depending on the standard fuel-injection characteristic previously stored. This makes it possible to inject the desired volume of injected fuel with no measurement of the fuel-injection characteristic over the whole pressure range at the individual injectors.

The standard conductive duration in the injectors may be provided by the multiplication of the correction coefficient by the standard conductive duration given depending on the standard fuel-injection characteristic. Hence, the controller unit may provide the standard conductive duration through a simple calculating process. In order to find the correction coefficient, it may be sufficient to simply store at least a pair the inherent data consisting of a specified conductive duration and a specified volume of injected fuel correspondingly to the standard conductive duration in the injectors with no necessity of troublesome effort for gathering the data of the injectors. Consequently, the injectors and the fuel-injection system incorporated with the injectors according to the present invention may be inexpensively provided irrespective of the dispersion or scattering in the fuel-injection characteristics of the injectors, because no rise in the production cost of the injectors may be necessary for improving the accuracy in finishing and assemblage and no huge effort may be necessary for gathering the data regarding to the fuel-injection characteristics.

Moreover, the correction quantity for compensating the standard conductive duration to determine the standard conductive duration of the individual injectors is given by storing plural pairs of the inherent data consisting each of the specified conductive duration and the specified volume of injected fuel corresponding to the standard conductive duration of the injectors, depending on the plural selected pressure ranges of the hydraulically actuated fluid applied in the injectors. While the correction quantity at the residual pressure ranges between the selected pressure ranges is given by interpolating the correction coefficient. Hence, no variation in pressure of the hydraulically actuated fluid causes the steep change in the correction coefficient so that the volume of injected fuel is eliminated from the sudden change that might otherwise result in the torque-shock in the engine. According to the fuel-injection system for the engine of the present invention as described above, the fuel-injection characteristics of the individual injectors are given by using the correction quantity and the process of interpolation, depending on the standard fuel-injection characteristic, so that no troublesome effort may be necessary for gathering data with taking parameters of the standard conductive duration, volume of injected fuel and pressure of the hydraulically actuated fluid.

Other objects and features of the present invention will be more apparent to those skilled in the art on consideration of the accompanying drawings and following specification wherein are disclosed preferred embodiments of the invention with the understanding that such variations, modifications and elimination of parts may be made therein as fall within the scope of the appended claims without departing from the spirit of the invention.

DETAILED DESCRIPTION OF THE PREFERRED EMBODIMENTS

Figure 7:
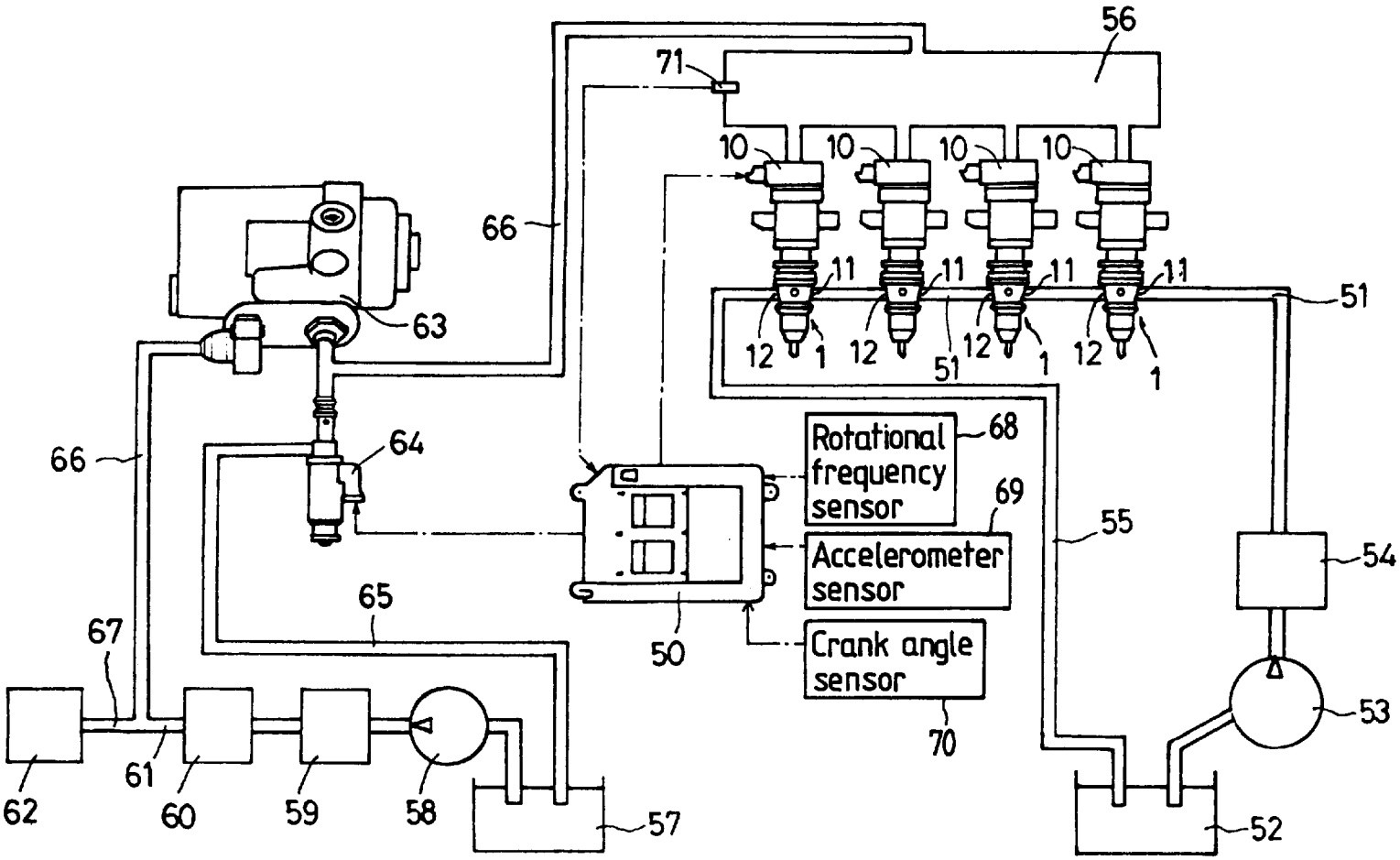
FIG. 7 is a schematic illustration of a fuel-injection system.
Figure 8:
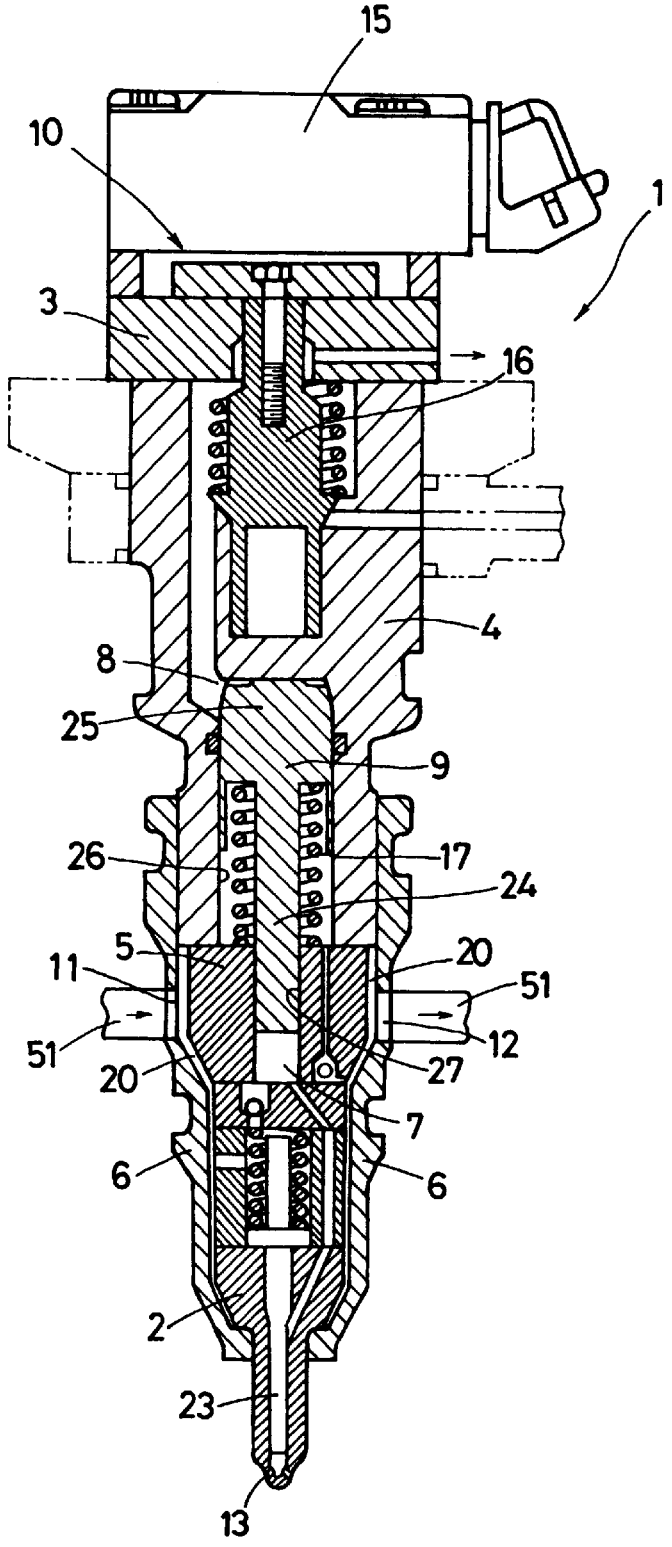
FIG. 8 is an axially sectioned view showing an exemplary injector adapted to the system in FIG. 7.

The present invention will be described in detail with reference to the accompanying drawings. It is to be noted that the prior fuel-injection system and the injectors shown in FIGS. 7 and 8 are simply adapted to a fuel-injection system and injectors incorporated in the system according to the present invention. In other words, the fuel-injection system of the present invention includes injectors that are each provided with a needle valve movable in an injector body in a reciprocating manner to open and close injection holes, and a solenoid-operated valve having an electromagnetic actuator that is applied with an actuating current so as to control a hydraulically actuated fluid for driving the needle valve upwards and downwards in a reciprocating manner, whereby the fuel to be injected out of the injector is regulated in injection timing and volume of injected fuel per cycle by a controller unit in response to the operating conditions of the engine. In the following description, the same reference character identifies equivalent or same parts or components and the repetition of the same parts or components will be omitted.

On the fuel-injection system for the engine, the controller unit 50 is to find a fundamental volume of injected fuel, depending on operating conditions of the engine, or a rotational frequency of the engine detected by the rotational frequency sensor 68 and a depression of the accelerator pedal detected by the accelerometer 55. The controller unit 50 is also stored beforehand with the standard fuel-injection characteristic representing the relation between the standard conductive duration of the actuating current and the volume of injected fuel. The standard fuel-injection characteristic is indicative of the data of the standard injector that is, for example, located at the central value of dispersion or scattering. The standard injector may be of an injector manufactured especially for the purpose or an injector having the average fuel-injection characteristic. It is to be noted that the actual fuel-injection characteristics of the individual injectors in the multicylinder engine usually differ from the standard fuel-injection characteristic of the standard injector.

Figure 1:
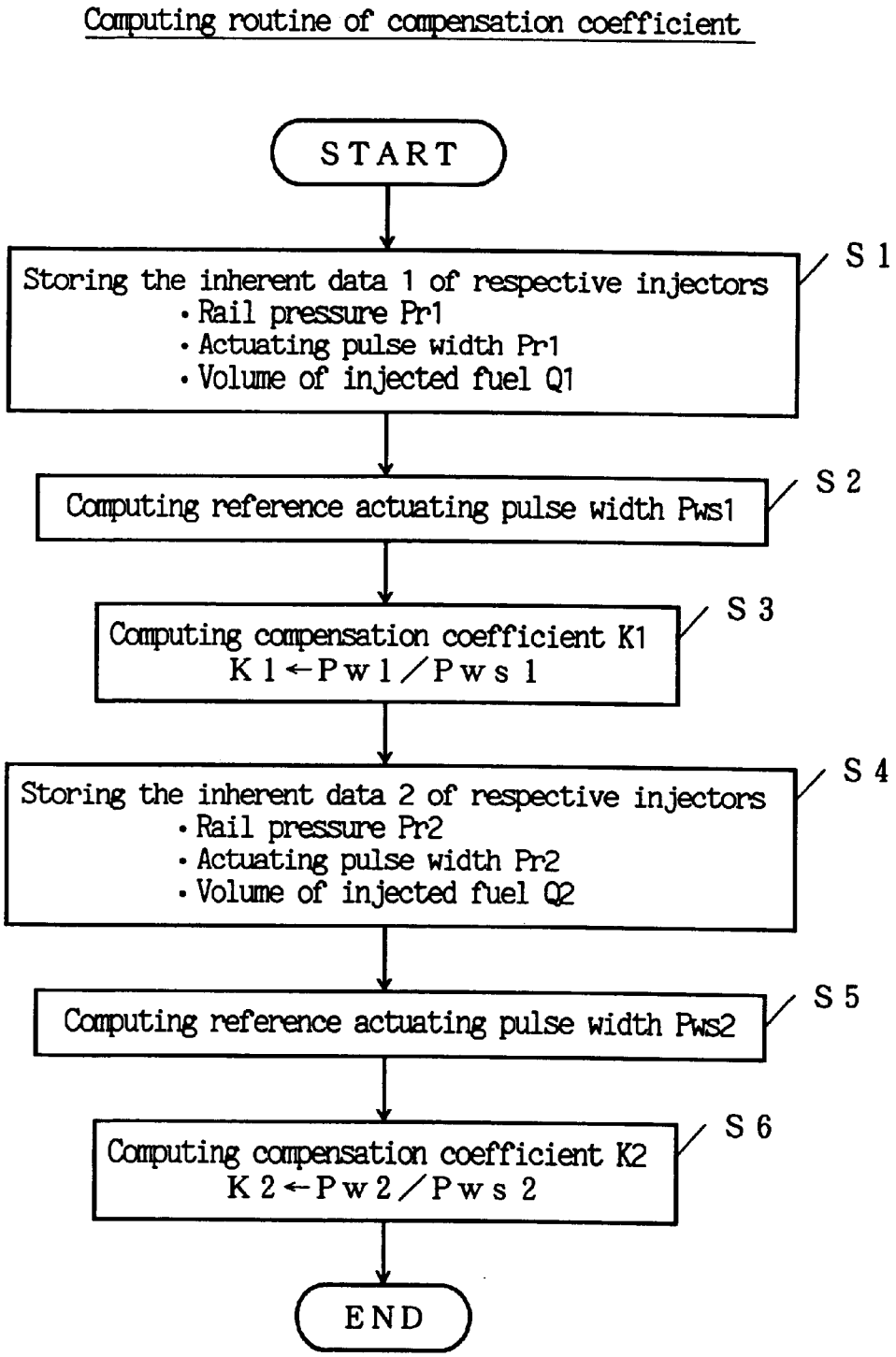
FIG. 1 is a flow chart illustrating a computing routine of a correction coefficient in a fuel-injection system for an engine according to the present invention.

On assemblage of the engine, a correction coefficient obtained by a computing routine in FIG. 1 is stored in a memory to compensate or correct the individual cylinders. Moreover in operation of the engine, a standard conductive duration for the individual injectors, or an actuating pulse width that is the ordinary type of an actuating current, may be found by using the correction coefficient in the memory along a computing routine shown in FIG. 2.

Figure 3:
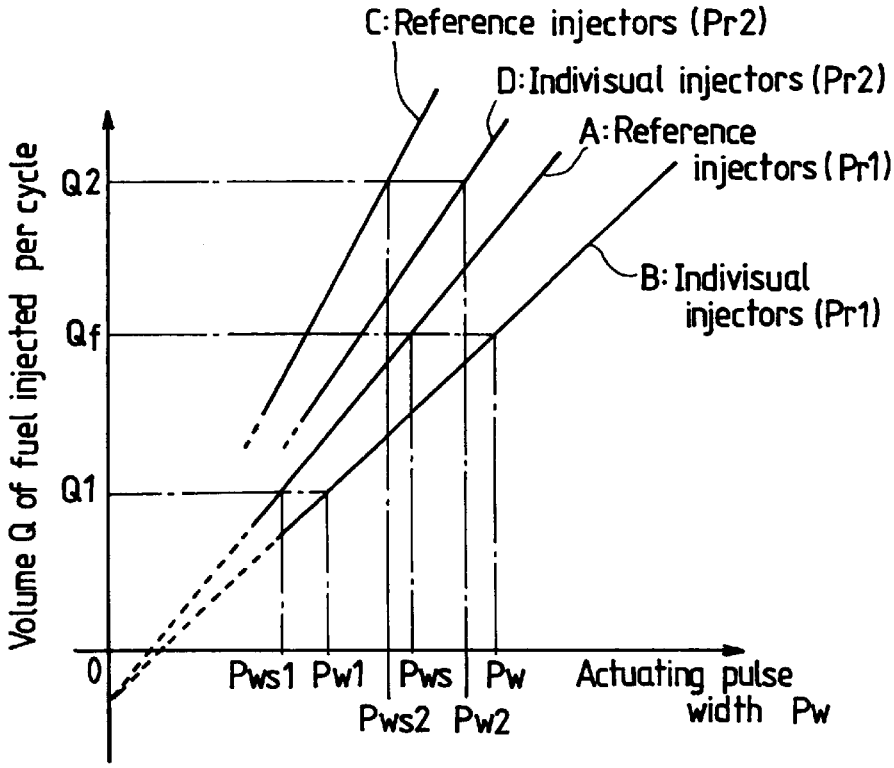
FIG. 3 is a graphical representation of a standard fuel-injection characteristic and other fuel-injection characteristics in individual injectors, in the relation of the actuating pulse width with the volume of injected fuel per cycle.
Figure 9:
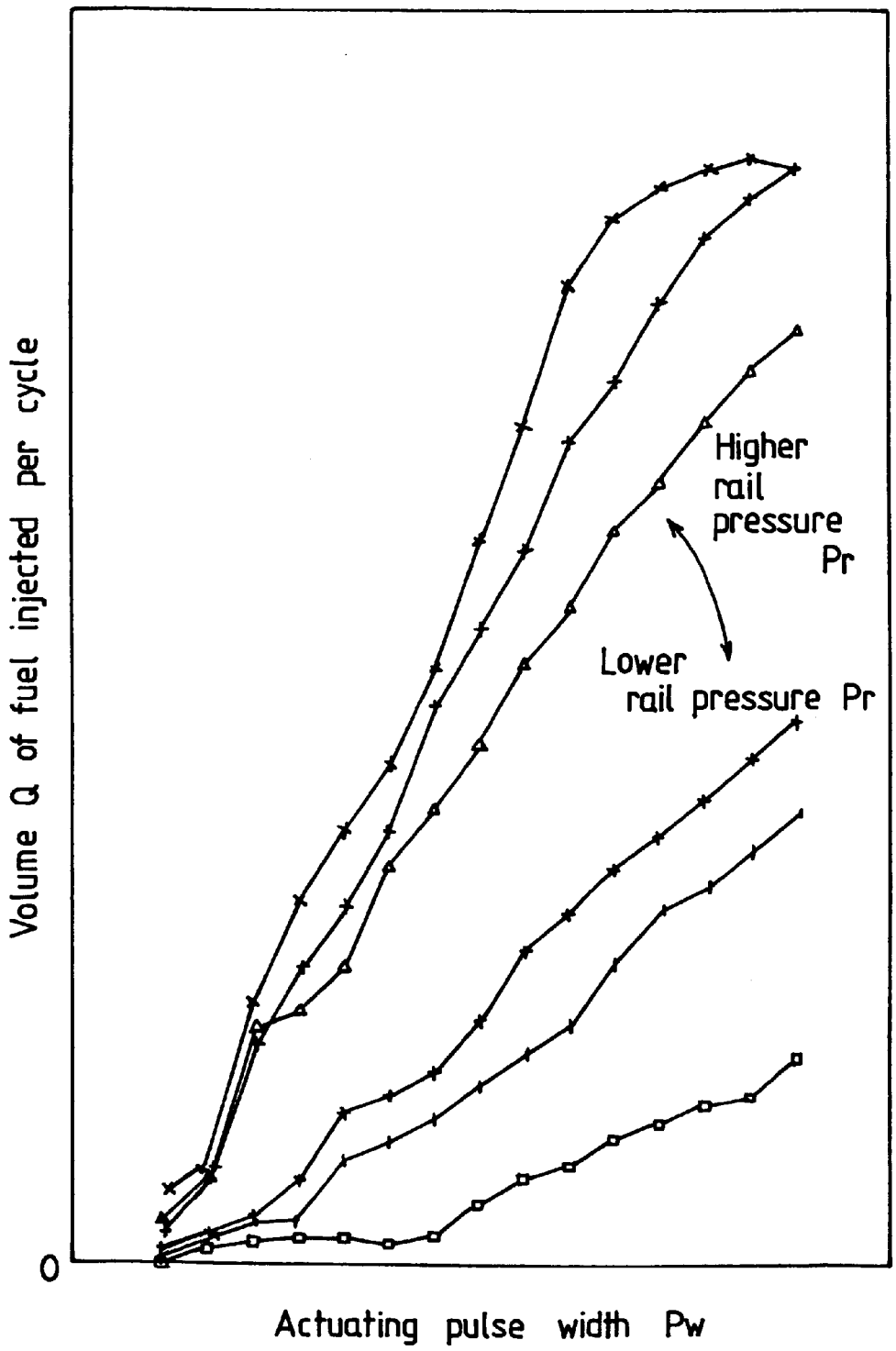
FIG. 9 is a graphical representation of coordinate relations between the actuating pulse width and the volume of fuel injected per cycle with taking a parameter of a rail pressure.

FIG. 1 is a flow chart of the computing routine for the correction coefficient that may be given by the steps described hereinafter. FIG. 3 is a graphical representation of a standard fuel-injection characteristic and other fuel-injection characteristics of the individual injectors, in the relation of the actuating pulse width versus the volume of injected fuel per cycle. Comparing approximate lines of the slopes at a specified operating point, it has been experimentally found that the actual fuel-injection characteristics of the individual injectors are different from the standard fuel-injection characteristic of the standard injector by the dispersion, which is represented as straight lines crossing on the ordinate, or y-axis, under the same rail pressures (for example, Pr1, Pr2). The standard fuel-injection characteristics A, C and the fuel-injection characteristics of the individual injectors B, D in FIG. 3 are the approximate lines of the slopes at the specified operating points under the rail pressures Pr1 and Pr2, whereas the actual data of the standard fuel-injection characteristics are mapped as shown in FIG. 9 while the actual data of the individual fuel-injection characteristics are simply provided as the data of the specified operating points as will be described hereinafter. The data of the individual injectors may be appended, for example, in the form of bar-coded data, following the measurement at the production of the individual injectors.

Step (S1)=The inherent data 1 of the individual injectors are stored. That is, if the volume Q1 of the injected fuel were computed when the solenoid 15 for the electromagnetic actuator was applied with an actuating pulse of an actuating pulse width Pw1, which is any standard conductive duration of the actuating current, under the rail pressure Pr1 of the hydraulically actuated fluid in the high-pressure manifold, the controller unit 50 would be stored with a set of inherent data 1 consisting of the rail pressure Pr1, actuating pulse width Pw1 and the volume Q1 of injected fuel, all of which have been already observed. In this case, the rail pressure Pr1 and the actuating pulse width Pw1 are determined on a lower rail pressure Pr1 and a smaller pulse width Pw1, respectively, corresponding to the low load.

Step (S2)=The standard actuating pulse width Pws1 for the standard conductive duration corresponding to the volume Q1 of injected fuel is computed depending on the standard fuel-injection characteristic stored in the controller unit 50.

Step (S3)=The correction coefficient K1 (or low pressure correction coefficient) corresponding to the inherent data 1 is given as $$K1=Pw1/Pws1$$

and stored in a memory.

Step (S4)=Likewise above S1, the inherent data 2 of the individual injectors are stored. That is, if the volume Q2 of the injected fuel were computed when the solenoid 15 for the electromagnetic actuator was applied with an actuating pulse of an actuating pulse width Pw2, which is any standard conductive duration of the actuating current, under the rail pressure Pr2 of the hydraulically actuated fluid in the high-pressure manifold, the controller unit 50 would be stored with another set of inherent data 2 consisting of the rail pressure Pr2, actuating pulse width Pw2 and the volume Q2 of injected fuel, all of which have been already observed. In this case, the rail pressure Pr2 and the actuating pulse width Pw2 are determined on a higher rail pressure Pr2 and a larger pulse width Pw2, respectively, corresponding to the high load.

Step (S5)=Likewise S2, the standard actuating pulse width Pws2 for the standard conductive duration corresponding to the volume Q2 of injected fuel is computed depending on the standard fuel-injection characteristic.

Step (S6)=Likewise S3, the second correction coefficient K2 (or high pressure correction coefficient) corresponding to the inherent data 2 is given as $$K2=Pw2/Pws2$$

and stored in a memory.

The routine described just above is executed on assemblage of the engine, more particular, on electric connection of the controller unit with the injectors.

Figure 2:
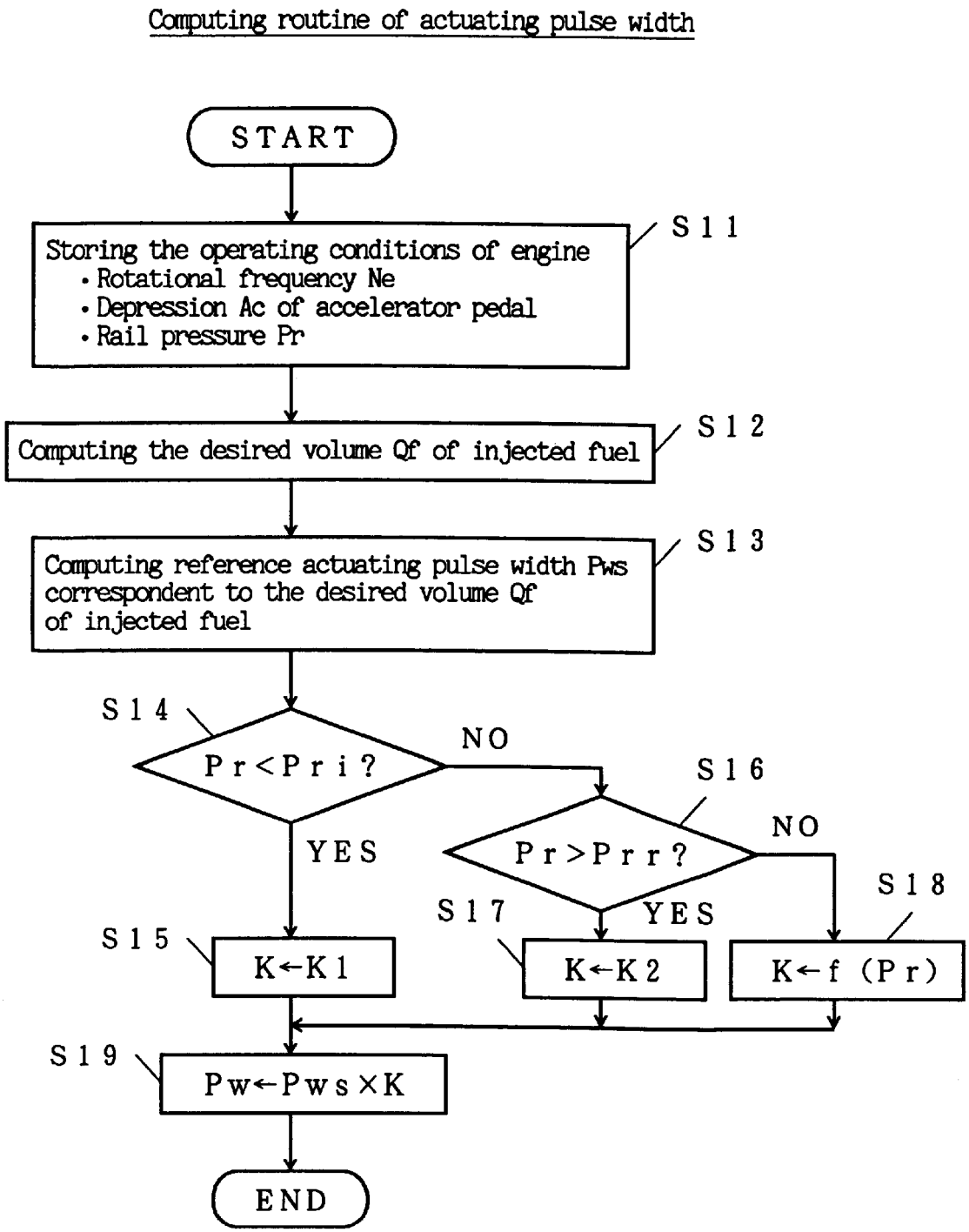
FIG. 2 is a flow chart illustrating a computing routine of an actuating pulse width in a fuel-injection system of an engine according to the present invention.

FIG. 2 is a flow diagram illustrating a computing routine of a standard conductive duration of an actuating current to be applied to the electromagnetic actuators of the individual injectors, or an actuating pulse width, by using the resultant correction coefficients obtained in the computing routine of the correction coefficient in FIG. 1. This computing routine is combined in the fuel-injection control routine during operation of the engine and the actuatingpulse width may be computed by the following steps.

Step (S11)=The operating conditions of the engine are stored. In this step, periodically stored in the controller unit 50 are a rotational frequency Ne of the engine detected at the rotational frequency sensor 68, a depression Ac of the accelerator pedal detected at the accelerometer 69 and a rail pressure Pr from a pressure sensor 71.

Step (S12)=The desired volume Qf of fuel to be injected is computed by using a previously determined map, for example, a map illustrative of the relation of the engine rotational frequency Ne versus the desired volume Qf of the injected fuel, with a parameter being taken as the depression Ac of the accelerator pedal, depending on the actual engine rotational frequency Ne and the actual depression Ac of the accelerator pedal.

Step (S13)=The standard actuating pulse width Pws for the standard conductive duration corresponding to the volume Qf of fuel to be injected is computed depending on the standard fuel-injection characteristic stored in the controller unit 50.

Step (S14)=It is discriminated whether or not the rail pressure Pr is less than a rail pressure Pri corresponding to a small load such as when idling. It is to be noted that the rail pressure Pri is made larger than the rail pressure Pri.

Step (S15)=When the decision (S14) is YES, the correction coefficient K1 in the memory is input as the correction coefficient K.

Step (S16)=When the decision (S14) is NO, it is further discriminated that whether or not the rail pressure Pr is more than a rail pressure Prr corresponding to a large load such as when operating under a high load. It is to be noted that the rail pressure Prr is made smaller than the rail pressure Pr2.

Step (S17)=When the decision (S16) is YES, the correction coefficient K2 in the memory is input as the correction coefficient K.

Figure 4:
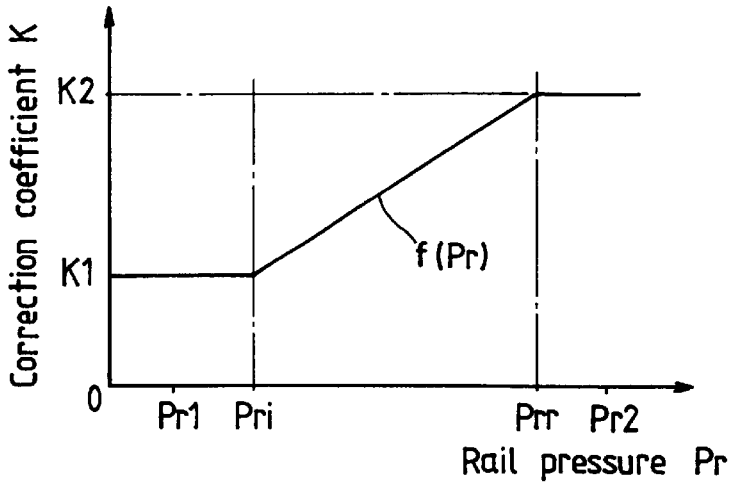
FIG. 4 is a graphical representation of a linear interpolation of the correction coefficient.

Step (S18)=When the decision (S14) is NO, a correction coefficient obtained as a function f of the rail pressure Pr is input for correction coefficient K. The function f(Pr) is linearly interpolated, for example, as shown in FIG. 4, but any other suitable interpolation may be fairly allowed; and Step (S19)=The final actuating pulse width Pw is obtained by the multiplication of the standard actuating pulse width Pws calculated at the step (S13) by the correction coefficient K1 found at the step (S15), (S17) or (S18).

Following the completion of the routine described just above, other main routine or sub-routine, not shown, is executed.

Figure 5:
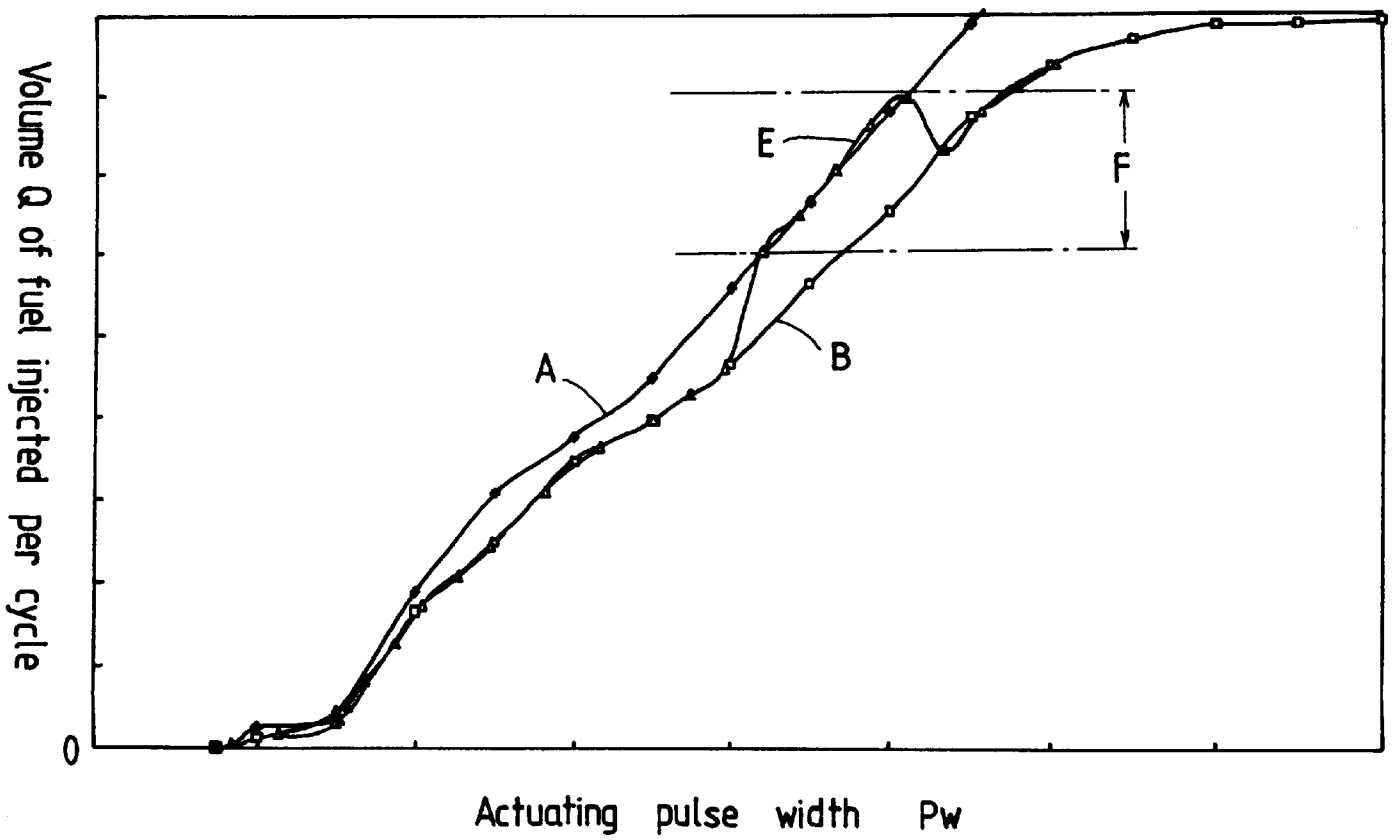
FIG. 5 is a graphical representation of the fuel-injection characteristics where the actuating pulse width is corrected by making use of the standard fuel-injection characteristic, fuel-injection characteristics in the individual injectors and the correction coefficient.
Figure 6:
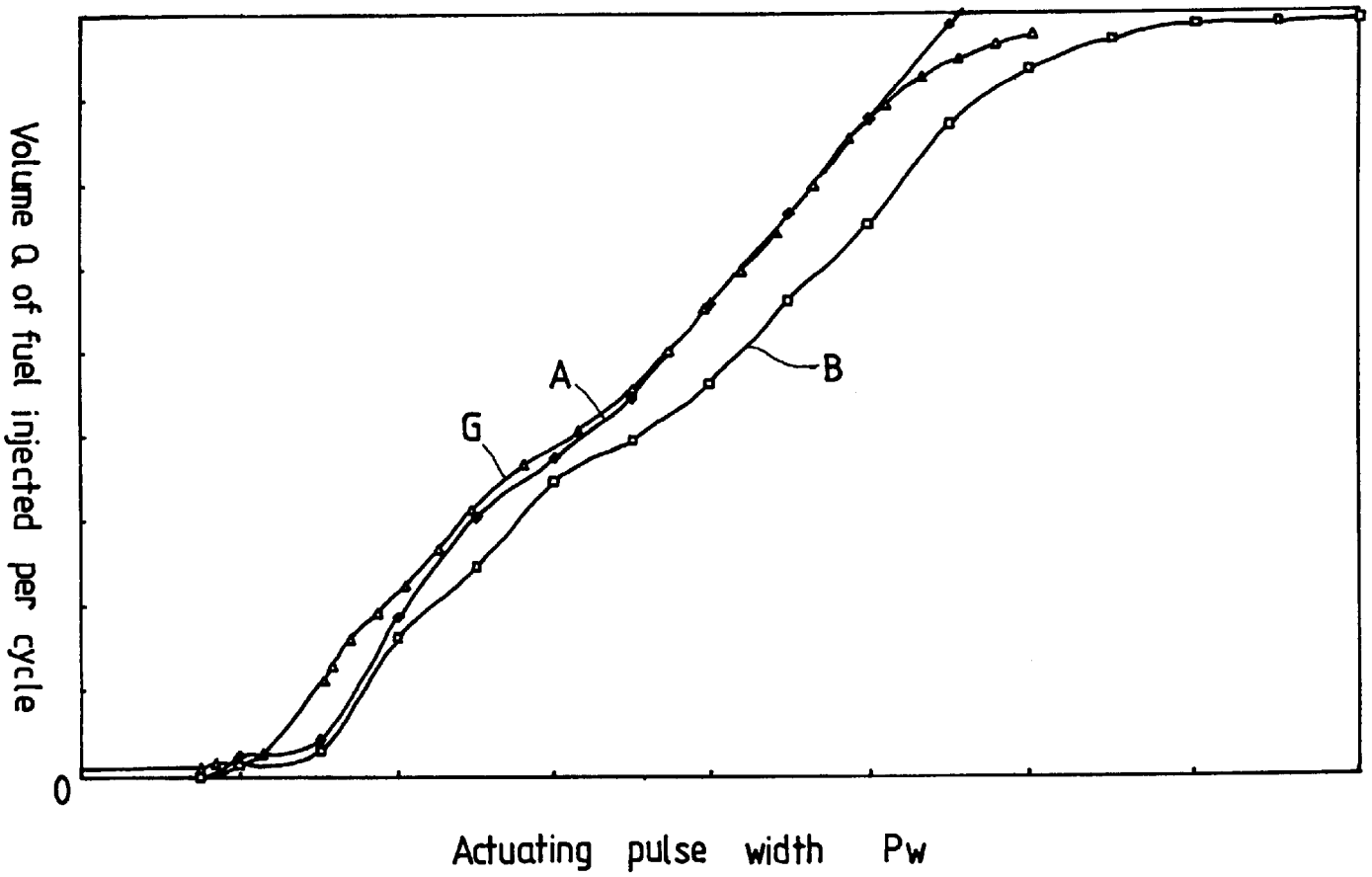
FIG. 6 is a graphical representation similar to FIG. 5, but the correction coefficient being linearly interpolated.

FIG. 5 graphically represents the fuel-injection characteristics E of the individual injectors, after corrected in the actuating pulse width by using the standard fuel-injection characteristic A, the individual fuel-injection characteristics B and the correction coefficient K2. The corrected individual fuel-injection characteristics results from the correction executed at a range F corresponding to the higher load, so that no correction of the pulse width is available at ranges other than a range F where the correction coefficient K2 may function effectively. As apparent from the graph in FIG. 5, the fuel-injection characteristics of the individual injectors may closely approximate at the corrected range F to the standard fuel-injection characteristic of the standard injector. FIG. 6 is a graphical representation likewise FIG. 5, in which the correction at the ranges exclusive of the range F is also carried out by using the process of interpolation, shown in FIG. 4, of the correction coefficient. According to FIG. 5, it will be found that the volume Q of the injected fuel undergoes steep changes at the boundaries of the corrected range. In contrast, the process of the interpolation makes the corrected fuel-injection characteristics G approximate closely to the standard fuel-injection characteristic A, resulting in eliminating the steep change in the volume Q of the injected fuel whereby the engine may be protected from the torque-shock.

Figure 10:
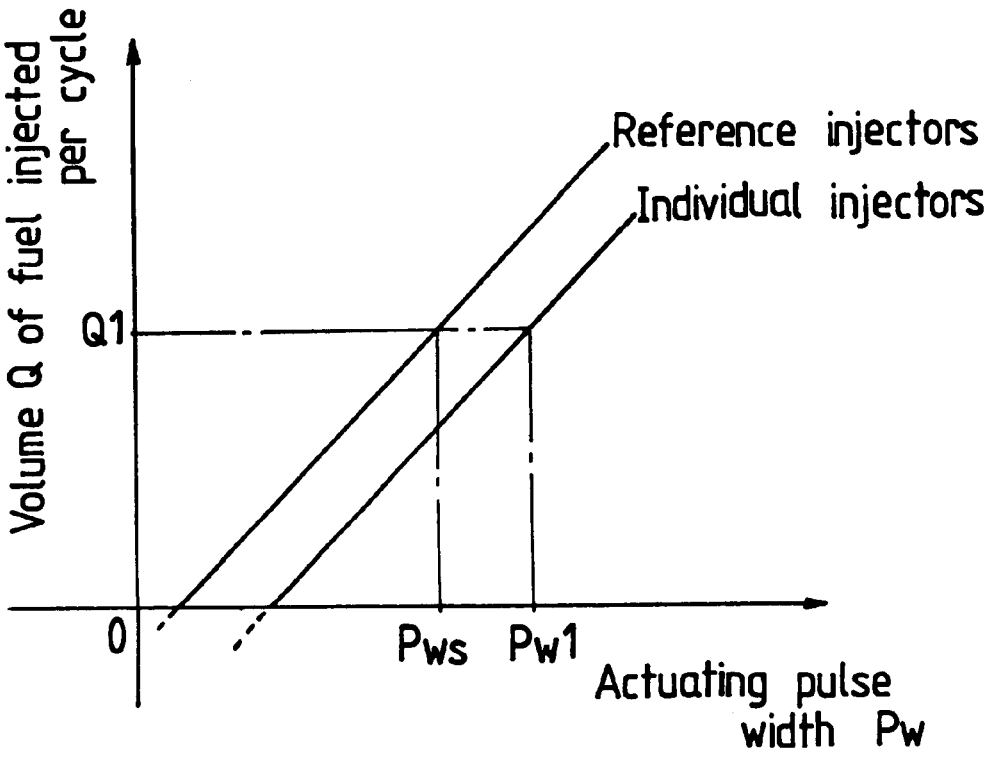
FIG. 10 is a graphical representation illustrating a standard fuel-injection characteristic and other fuel-injection characteristics in individual injectors, in the relation of the actuating pulse width versus the volume of injected fuel per cycle, but different in dispersion pattern from the graph in FIG. 3.

Graphically shown in FIG. 10 are both the standard fuel-injection characteristic and the fuel-injection characteristics of the individual injectors, which are different from FIG. 3 in the scattering pattern. The scattering pattern in FIG. 10 is such that the fuel-injection characteristics may move in parallel with the standard injector, depending on the change of the actuating pulse width versus the volume of injected fuel. In this case, the pulse width Pw to be corrected for injecting the constant volume Q1 of fuel is given by the deviation $\Delta Pw$ (=Pw1−Pws). That is, the pulse width to be corrected, or a correction quantity, is defined as the deviation of the actuating pulse width Pw1 in the individual injectors from the actuating pulse width Pws obtained in correspondence with the same volume Q1 of injected fuel for the specified operating point, depending on the standard fuel-injection characteristics. The actuating pulse width Pw of the individual injectors is obtained by adding the correction quantity, or the correction pulse width $\Delta Pw$, to the standard actuating pulse width Pws corresponding to the desired volume of injected fuel that is determined dependent on the operating conditions of the engine.

It should be understood that the foregoing relates to only preferred embodiments of the present invention, and that is intended to cover all changes and modifications of the examples of the invention herein chosen for the purposes of the disclosure, which do not constitute departure from the spirit and scope of the invention.

What is claimed is:

1. A fuel-injection system for an engine, comprising injectors each provided with injection holes through which fuel is injected into the engine and an electromagnetic actuator applied with an actuating current so as to control a hydraulically actuated fluid to open and close the injection holes, means for detecting operating conditions for the engine, and a controller unit for determining a desired volume of injected fuel corresponding to the operating conditions obtained at the detecting means and further regulating a conductive duration of the actuating current to the electromagnetic actuator depending on the desired volume of injected fuel, to thereby control a volume of fuel injected out of each of the individual injectors, the controller unit being stored with a standard fuel-injection characteristic that has been previously found in a relation between the volume of injected fuel and a standard conductive duration in any standard injector out of the injectors, and the controller unit being further stored with at least a pair of previously observed inherent data consisting of a specified conductive duration in each of the injectors and a specified volume of injected fuel corresponding to the specified conductive duration, thereby to find a correction coefficient in the form of a ratio of the specified conductive duration in each of the injectors to the standard conductive duration that is given corresponding to the specified volume of injected fuel, depending on the standard fuel-injection characteristic, whereby the conductive duration to the electromagnetic actuator of each of the individual injectors for determining the desired volume of injected fuel at each of the injectors is provided by multiplying the correction coefficient and the standard conductive duration together, which is found depending on the standard fuel-injection characteristic.

2. A fuel-injection system for an engine, comprising injectors each provided with injection holes through which fuel is injected into the engine and an electromagnetic actuator applied with an actuating current so as to control a hydraulically actuated fluid to open and close the injection holes, means for detecting operating conditions for the engine, and a controller unit for determining a desired volume of injected fuel corresponding to the operating conditions obtained at the detecting means and further regulating a conductive duration of the actuating current to the electromagnetic actuator, depending on the desired volume of injected fuel, to thereby control a volume of fuel injected out of each of the individual injectors, the controller unit being stored with a standard fuel-injection characteristic that has been previously found in a relation between the volume of injected fuel and a standard conductive duration in any standard injector out of the injectors, and the controller unit being further stored with at least a pair of previously observed inherent data consisting of a specified conductive duration in each of the injectors and a specified volume of injected fuel corresponding to the specified conductive duration, thereby to find a correction coefficient in the form of a difference between the specified conductive duration in each of the injectors and the standard conductive duration that is given corresponding to the specified volume of injected fuel, depending on the standard fuel-injection characteristic, whereby the conductive duration to the electromagnetic actuator of each of the individual injectors for determining the desired volume of injected fuel at each of the injectors is provided by adding the correction coefficient and the standard conductive duration, which is found depending on the standard fuel-injection characteristic.

3. A fuel-injection system for an engine according to claim 1, wherein the injectors are each provided with a solenoid-operated valve having a needle valve movable in a body upwards and downwards in a reciprocating manner so as to open and close the injection holes and the electromagnetic actuator applied with the actuating current to control a hydraulically actuated fluid to make the needle valve move upwards and downwards.

4. A fuel-injection system for an engine according to claim 3, wherein the injectors are each comprised of an intensified chamber supplied with fuel from a common fuel supply rail, a pressure chamber supplied with the hydraulically actuated fluid, a boosting piston driven by the hydraulically actuated fluid to pressurize the fuel in the intensified chamber, a return spring for forcing the boosting piston towards its neutral position, and a casing formed with a fuel chamber and also a fuel inlet and a fuel outlet, both of which are communicated with the common fuel supply rail, the needle valve being made to move upwards and downwards dependently on the hydraulic pressure of the fuel from the intensified chamber to thereby open and close the injection holes through which is injected the fuel, and the solenoid-operated valve being provided with a valve body actuated by the electromagnetic actuator to regulate the supply of the hydraulically actuated fluid to the pressure chamber.

5. A fuel-injection system for an engine, comprising injectors each provided with injection holes through which fuel is injected into the engine and an electromagnetic actuator applied with an actuating current so as to control a hydraulically actuated fluid to open and close the injection holes, means for detecting operating conditions for the engine, and a controller unit for determining a desired volume of injected fuel corresponding to the operating conditions obtained at the detecting means and further regulating a standard conductive duration of the actuating current to the electromagnetic actuator as well as the pressure of the hydraulically actuated fluid, depending on the desired volume of injected fuel, to thereby control a volume of injected out of the injectors, the controller unit being stored with a standard fuel-injection characteristic that has been previously found in a relation between the volume of injected fuel and a standard conductive duration whereby the conductive duration to the electromagnetic actuator of each of the individual injectors for determining the desired volume of injected fuel at each of the injectors is provided by correcting the standard conductive duration, which is found corresponding to the desired volume of fuel to be injected depending on the standard fuel-injection characteristic, by using a correction quantity, the correction quantity being obtained for each of plural selected pressure ranges while the correction quantity at residual pressure ranges between the selected pressure ranges being provided by the interpolation of the correction quantity at the selected pressure ranges.

6. A fuel-injection system for an engine according to claim 5, wherein the correction quantity at the residual pressure range between the selected pressure ranges is given by the linear interpolation of the correction quantity.

7. A fuel-injection system for an engine according to claim 5, wherein the selected pressure ranges and the correction quantities for the pressure ranges are of a paired low-pressure range and low-pressure correction quantity for the low-pressure range and another paired high-pressure range and high-pressure correction quantity for the high-pressure range.

* * * * *